United States Patent [19]

Booty

[11] 4,099,817

[45] Jul. 11, 1978

[54] TRACK LIGHTING

[75] Inventor: Donald J. Booty, 513 Durham Dr., Frankfort, Ill. 60423

[73] Assignees: Donald J. Booty; Marvin Feig, both of Chicago, Ill.

[21] Appl. No.: 763,184

[22] Filed: Jan. 27, 1977

[51] Int. Cl.[2] ..... H01R 7/06; H01R 13/54

[52] U.S. Cl. ..... 339/22 B; 339/74 R; 339/75 M

[58] Field of Search ..... 339/20, 21 R, 22 R, 339/22 B, 23, 74 R, 74 L, 75 R, 75 M, 76, 77

[56] References Cited

U.S. PATENT DOCUMENTS

| | | | |
|---|---|---|---|
| 2,192,899 | 3/1940 | Edmonson | 339/21 R |
| 2,261,986 | 11/1941 | Frank | 339/21 R |
| 2,309,972 | 2/1943 | Messing | 339/21 R |
| 3,596,226 | 7/1971 | Meltzer | 339/21 R |
| 3,871,730 | 3/1975 | Hesse | 339/21 R |
| 4,032,208 | 6/1977 | Berkenhoff | 339/21 R |

*Primary Examiner*—Roy Lake
*Assistant Examiner*—E. F. Desmond
*Attorney, Agent, or Firm*—Seidel, Gonda & Goldhammer

[57] ABSTRACT

A lamp and support housing are adapted for movement along the length of a power supply track. The housing supports movable contacts each adapted to be electrically coupled to a discrete conductor bus in the track. An actuator on the housing moves the contacts between an inoperative retracted position and an operative extented position. Access to the conductor buses is attained by way of slots on opposite faces of the track.

13 Claims, 5 Drawing Figures

TRACK LIGHTING

RELATED CASE

Reference is made to my U.S. Pat. No. 4,003,618 for a "Multiple Socket Strip."

BACKGROUND

The subject matter involved herein is believed to be classified in Class 339.

U.S. Pat. No. 2,977,576 is representative of prior art wherein the conductive buses are facing one another in a channel of the track. Conductive buses of that configuration are subject to accidental contact by way of a metal probe introduced into the channel.

The provision of buses each having an entry slot on opposite faces of the track is known from U.S. Pat. Nos. 2,437,579; 2,856,592; 2,261,986. In those patents, access to the conductive buses relies on flexibility of one or more components and/or relies on rotation of the entire housing. Neither of those concepts are practical or are not acceptable to approval by Underwriter Laboratories.

The present invention provides for an assembly having increased safety, while at the same time providing a more versatile assembly capable of being inexpensively constructed and having other features and advantages.

SUMMARY OF THE INVENTION

The apparatus of the present invention includes a housing having a receptacle supported on one side thereof. The other side of the housing has a recess for embracing a track. A pair of movable contacts are supported by the housing and electrically coupled to the receptacle.

A movable actuator is supported by the housing. The actuator is coupled to the contacts for selectively moving the contacts relative to the housing between an inoperative retracted position and an operative extended position. The free end of each contact is adapted to engage a discrete conductor bus only when the contacts are in an operative position.

It is an object of the present invention to provide track lighting which has increased safety features to prevent accidental contact with a conductor bus while being attractive, versatile, efficient and having other features as will be made clear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown in FIG. 1 track lighting in accordance with the present invention designated generally as 10.

Figure 1:
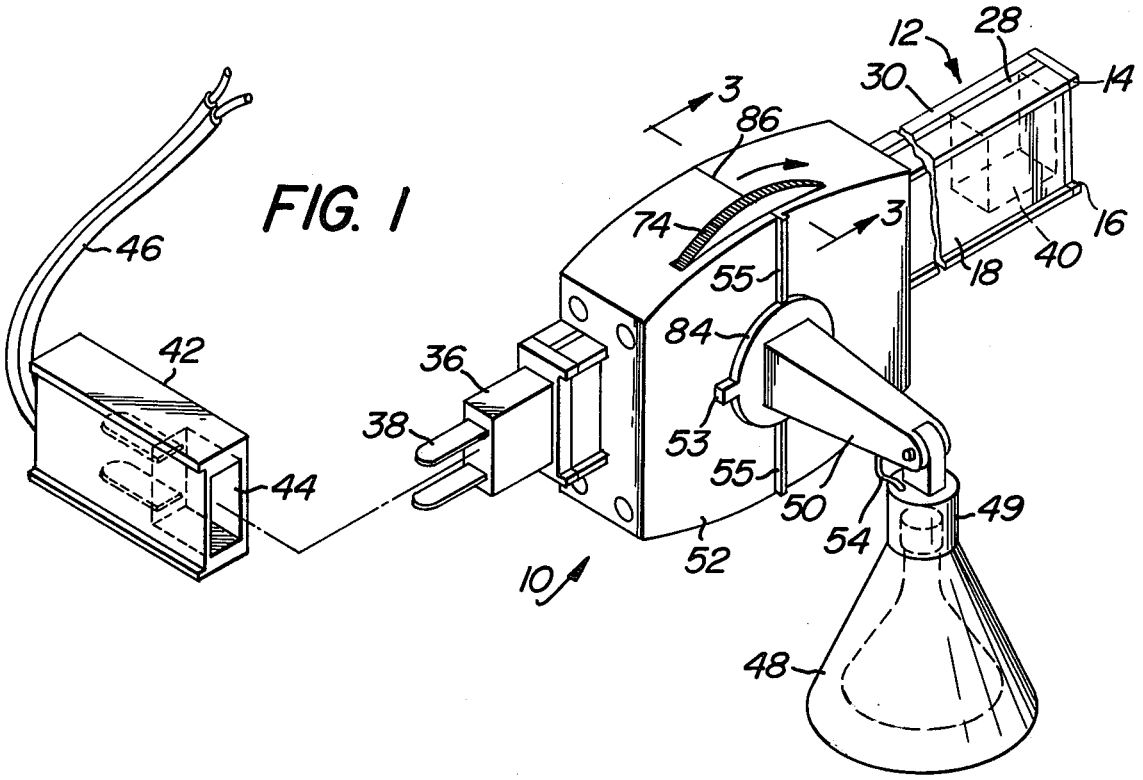
FIG. 1 is an exploded perspective view of the present invention.

A track 12 extruded from any suitable material such as plastic, aluminum or the like is provided. The track

12 has an upper guide rib 14 and a lower guide rib 16 on the front face 18. The front face 18 may be decorated in any suitable manner so that the track may be artistically and aesthetically compatible with the surroundings.

The track 12 has a rear face 20 defined by a plurality of spaced parallel surfaces aligned with one another and having a centrally disposed longitudinally extending T-shaped recess 22. The track 12 has a pair of longitudinally extending slots which are parallel to the front face 18 and rear face 20. An electrical conductor bus 24 is provided in one of the slots and a similar bus 26 is provided in the other slot. If track 12 is made of metal, each bus 24, 26 is electrically insulated from the track. A groove 28 is provided in the side face 30 and extends to the bus 24. On the opposite side face 34, there is provided a groove 32 which extends to the bus 26. Each of the grooves 28 and 32 are curved. Due to the curvature of the grooves 28, 32, accidental contact with a bus is highly unlikely.

The track 12 is provided with a plug 36 at one end from which extend contacts 38. The transverse dimensions of the plug 36 are less than the transverse dimensions of the track 12. The other end of the track 12 is provided with a socket 40 having female contacts electrically coupled to the buses 24, 26. The dimensions of the socket 40 are of such size so as to receive a plug 36 on an adjacent track whereby two adjacent tracks may be coupled together with no unsightly gap between them. Stated otherwise, the tracks 12 are adapted to be telescopically coupled to one another while simultaneously effecting electrical contact between the buses on one track and the buses on the other track.

A power connector 42 is provided. The connector 42 has a socket 44 adapted to receive the plug 36 so that the contacts 38 may be electrically coupled to the conductors 46. The connector 42 has transverse dimensions comparable to the dimensions of the track 12 and has the appearance of being a continuation thereof.

A lamp 48 is connected to receptacle 49 which is pivotably coupled to one end of a bracket arm 50. The other end of bracket arm 50 is rotatably connected to a housing 52 for rotation through an arc of 180°. The arc of rotation is defined by the ribs 55 on the housing 52 which are adapted to be engaged by the lug 53 on the bracket arm 50. Electrical wires 54 extend through the bracket arm 50 to the receptacle 49.

Figure 2:
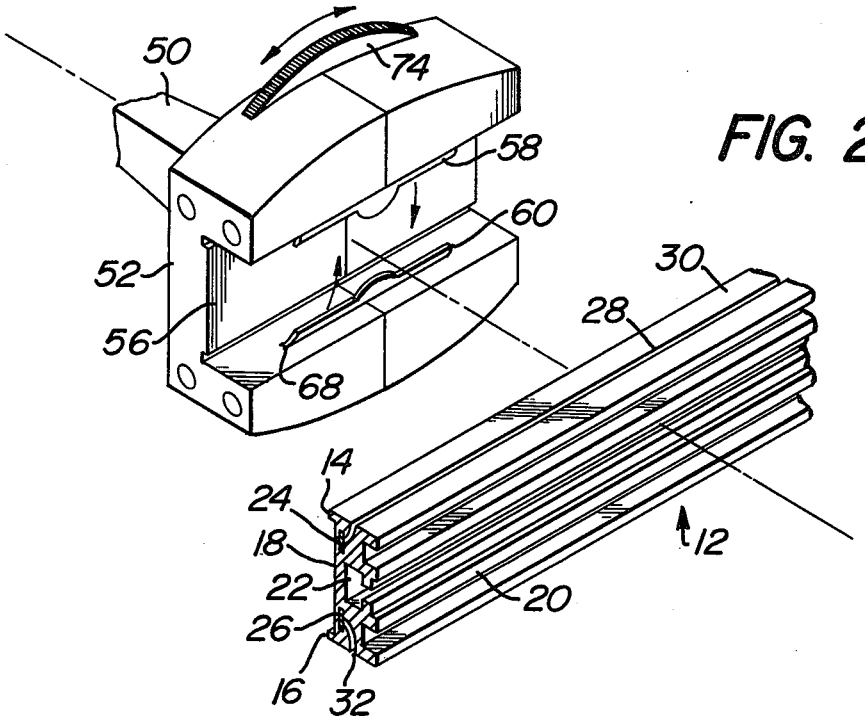
FIG. 2 is an exploded perspective view of the track and housing from the opposite side as shown in FIG. 1.

As shown more clearly in FIG. 2, the housing 52 has a recess 56 on its rear face for embracing the faces 18, 30 and 34 on the track 12. A pair of curved contacts 58, 60 are movably supported by the housing adjacent opposite sides of said recess 56. Each of the contacts 58, 60 are electrically coupled to the receptacle 49 by one of the wires 54. Contact 58 has a contact surface 62 in its central region and of a length substantially shorter than the length of contact 58. A similar contact surface 64 is provided on contact 60.

The housing 52 is provided with a curved passageway 66 which is aligned with the slot 28 in track 12. Housing 52 is provided with a curved passageway 68 aligned with the groove 32 in the track 12.

Figure 3:
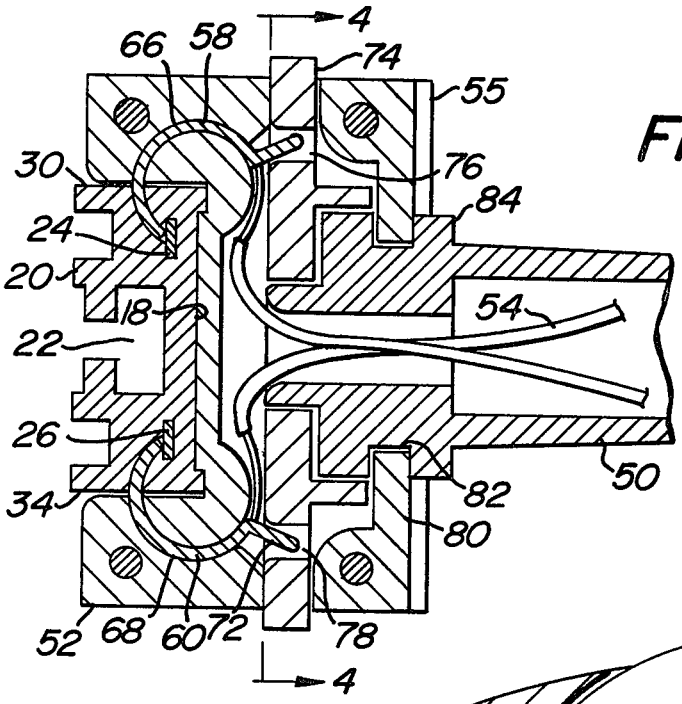
FIG. 3 is a sectional view taken along the line 3—3 in FIG. 1 but on an enlarged scale.
Figure 4:
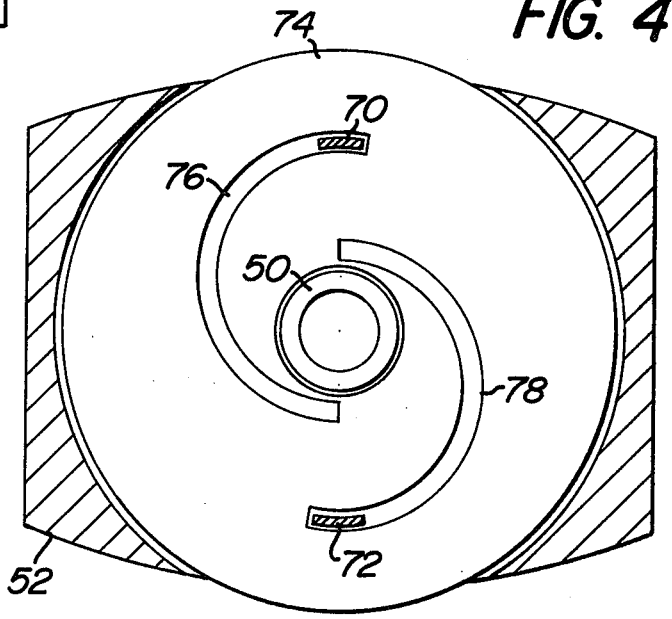
FIG. 4 is a sectional view taken along the line 4—4 in FIG. 3.
Figure 5:
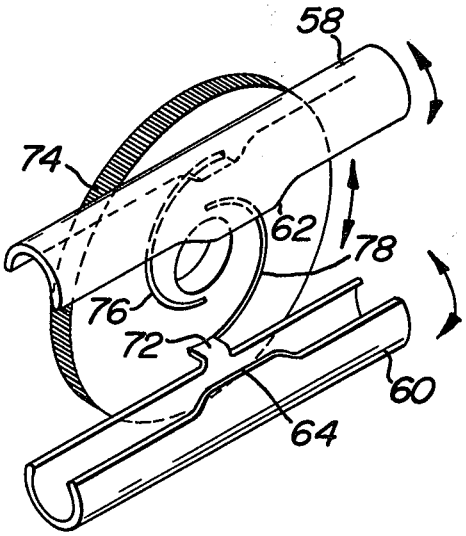
FIG. 5 is a perspective view of the actuator and the contacts.

The contacts 58 and 60 are supported for movement between an inoperative retracted position wherein the contacts are disposed entirely within their curved passageways and an extended operative position a shown in FIG. 3. An actuator 74 is provided to facilitate manual movement of the contacts 58, 60. The actuator 74 has a spiral cam slot 76 and a diametrically opposite spiral cam slot 78. A tongue 70 on contact 58 extends into the cam track 76. A tongue 72 on the contact 60 extends into the cam track 78. See FIGS. 4 and 5.

As shown more clearly in FIG. 3, the front wall 80 of the housing 52 rotatably supports the bracket arm 50 by extending into a circumferential groove 82 on a circular portion of arm 50. Flange 84 on bracket arm 50 overlies the front face 80. The actuator 74 is rotatably supported by the arm 50 for rotation about the longitudinal axis of arm 50 which is concentric therewith. The periphery of actuator 74 is preferably milled to facilitate good surface contact with one's fingers. To facilitate assembly of the housing 54, it is preferably molded or cast from suitable materials such as aluminum or plastic and joined along a centrally disposed parting line 86. The front face 18 on the track 12 is preferably provided with a plurality of mounting holes at spaced locations therealong and equidistant from the ribs 14 and 16 so as to be in an area opposite the recess 22. The mounting holes facilitate mounting the track 12 on a vertical surface, horizontal surface or any other angularly disposed surface.

In view of the above description, the manner in which the housing 52 and the lamps supported thereby is electrically coupled to the track 12 should be readily apparent to those skilled in the art. Before attaching the housing 52 to the track 12, actuator 74 is rotated in one direction so as to retract the contact 58 into its passageway 66 and to retract the contact 60 in its passageway 68. Thereafter, the housing 52 is positioned so that the track 12 is received within the recess 56. Rotation of the actuator 74 in the opposite direction causes the contacts 58 and 60 to extend into the curved slots 28 and 30, respectively, for contact with the buses 24, 26, respectively. Whenever it is desired to merely slide the housing 52 along the length of the track 12, the actuator 74 is partially rotated so as to cause the contacts 58, 60 to lose contact with the buses 24, 26, respectively before repositioning the housing 52 along the length of the track 12. At all positions along the entire length of the track 12, electrical contact may be made with the buses 24, 26 for lighting the lamp 48.

The actuator 74 preferably has a diameter so that a segmental portion extends above and below the housing 52. The contacts 58, 60 preferably have sufficient bending strength so as to support the housing 52 and lamp 48 when the track 12 is secured to a ceiling. As the housing 52 is shifted along the length of the track 12, the ribs 14 and 16 guide the housing 52 to prevent relative rotation. The center of curvature of contact 58, its passageway 66, and slot 28 is perpendicular to the axis of rotation of actuator 74. The same is true for contact 60, passageway 68, and slot 32. It will be noted that most of the components of the present invention are extrudable or cast to shape so as to minimize machining requirements.

The present invention may be embodied in other specific forms without departing from the spirit or essential attributes thereof and, accordingly, reference should be made to the appended claims, rather than to the foregoing specification as indicating the scope of the invention.

I claim:

1. Apparatus comprising a housing having a generally U-shaped recess on one side for embracing outer faces of a track, a pair of curved movable contacts supported by the housing adjacent said recess, said housing having curved discrete passageways whose curvature corresponds to that of said contacts for slidably accommodating and guiding said contacts on opposite sides of said recess, a pair of electrical conductors extending through said housing, each conductor having one end electrically connected to one of said contacts, a movable actuator means supported by said housing and coupled to said contacts for selectively moving said contacts along a curved path corresponding to said passageways relative to said housing between an inoperative retracted position wherein said contacts are in said passageways and an operative position wherein the contacts extend into said recess, the free end of each contact being adapted to engage a conductor bus on a track only when the contacts are in their operative position.

2. Apparatus in accordance with claim 1 wherein said actuator has a pair of cam surfaces each cooperatively associated with one of said contacts for moving its associated contact as the actuator is moved relative to said housing.

3. Apparatus in accordance with claim 2 wherein said actuator is annular and rotatably supported by said housing for rotation about its axis, said conductors extending through a hole at the center of said actuator.

4. Apparatus in accordance with claim 3 including a bracket arm rotatably coupled to said housing, said bracket arm being rotatable about the axis of said actuator, said conductors extending through said bracket arm to a receptacle means on said bracket arm.

5. Apparatus comprising a track having a pair of longitudinally extending parallel conductive buses, a slot on opposite outer faces of said track, each slot extending to one of said buses, said faces being substantially parallel to one another, a housing, a receptacle means supported by said housing on one side thereof, another side of said housing having a recess embracing said track and overlying said track faces, said recess being generally U-shaped, a pair of movable contacts supported by the housing adjacent opposite sides of said recess, said contacts being electrically coupled to said receptacle means, said housing having a discrete passageway for slideably receiving each contact, each passageway terminating in a face of said recess adjacent one of said slots, a movable actuator supported by said housing and coupled to said contacts for simultaneously and selectively moving said contacts relative to said housing between an inoperative position wherein the contacts are disposed within their housing passageway and an operative extended position wherein each of the contacts extend into one of said slots for engagement with one of said buses, the distance between the free ends of said contacts when in their operative position being less than the corresponding distance when the contacts are in their inoperative position, each of said passageways and slots being curved, each slot and its associated passageway having a common center of curvature, each contact being curved with the center of curvature corresponding to the center of curvature of its associated passageway and slot.

6. Apparatus comprising a housing having a recess on one side thereof for enabling the housing to embrace outer peripheral faces of a track, a pair of curved passageways supported by the housing adjacent opposite sides of said recess, a pair of curved electrical contacts whose curvature corresponds to that of said passageways, each contact being at least partially disposed in one of said passageways, a movable actuator means supported by said housing and being coupled to said contacts for selectively moving said contacts relative to said housing between an inoperative retracted position wherein free end portions of said contacts are in said housing passageways and an operative extended position wherein said contact end postions extend into said recess, a free end portion of each contact being adapted to engage a conductor bus of a track only when it is in its operative position, a track in said recess and embraced by said housing, said track having a curved slot on opposite faces for receiving one of said contacts, each track slot being aligned with and forming extension of one of said passageways, each track slot terminating in a bus.

7. Apparatus in accordance with claim 6 wherein said each slot and its associated passageway has a common center of curvature which is parallel to its associated bus.

8. Apparatus in accordance with claim 6 wherein said track has a rear face generally perpendicular to said opposite faces, said rear face having a generally T-shaped recess for receiving a member for mounting said track to a wall.

9. Apparatus in accordance with claim 6 wherein said actuator is rotatably supported by said housing for rotation about an axis which is perpendicular to the centers of curvature of said passageways.

10. Apparatus in accordance with claim 6 including a track having a curved slot on opposite outer side faces, each slot extending inwardly to a discrete bus, and said housing overlying each of said faces, said housing supporting said contacts so that they may extend in their operative position into one of said track slots for contact with the bus.

11. Apparatus in accordance with claim 10 wherein said track has a plug and contacts at one end, said track having a socket at its opposite end, said socket being of sufficient size so as to receive a comparable plug on another track so that the buses on one track may be electrically coupled to the buses on another track aligned therewith.

12. Apparatus in accordance with claim 6 wherein a receptacle is connected to said housing by way of a bracket arm, said bracket arm being rotatably connected to said housing about an axis, said actuator being rotatably supported by said housing for rotation about said axis.

13. Apparatus in accordance with claim 12 wherein said actuator is rotatably supported by said bracket arm within said housing.

* * * * *